United States Patent [19]

Segundo et al.

[11] 4,062,204

[45] Dec. 13, 1977

[54] HIGH LUSTER INTERLOCK FABRIC INCORPORATING PRODUCER TWIST YARNS

[75] Inventors: Mariano Segundo; Rodolfo Auerbach; Rolando Antonio Juan Castellazzo, all of Buenos Aires, Argentina

[73] Assignee: Ancase S.A., Buenos Aires, Argentina

[21] Appl. No.: 586,511

[22] Filed: June 12, 1975

Related U.S. Application Data

[63] Continuation-in-part of Ser. No. 370,874, June 18, 1973, abandoned.

[51] Int. Cl.[2] ..... D04B 9/08; D04B 1/16; D04B 1/18

[52] U.S. Cl. ..... 66/196; 66/178 A

[58] Field of Search ..... 66/196, 202, 197, 171, 66/200, 136, 178 A, 169 R, 146

[56] References Cited

U.S. PATENT DOCUMENTS

| | | | |
|---|---|---|---|
| T788,691 | 6/1969 | Elia et al. | 66/178 A |
| 1,087,690 | 2/1914 | Scott et al. | 66/197 X |
| 2,325,078 | 7/1943 | Shelmire | 66/200 |
| 2,511,685 | 6/1950 | Anderson | 66/200 X |
| 2,939,201 | 6/1960 | Holland | 66/202 X |
| 2,939,201 | 7/1960 | Holland | 66/202 |
| 2,979,928 | 4/1961 | Seghezzi | 66/200 X |
| 3,069,885 | 12/1962 | Cooper et al. | 66/202 X |
| 3,098,369 | 7/1963 | Burleson et al. | 66/202 X |
| 3,109,278 | 11/1963 | Gibson, Jr. | 66/202 X |
| 3,109,278 | 11/1963 | Gibson, Jr. | 66/202 X |
| 3,156,607 | 11/1964 | Strachan | 66/202 X |
| 3,241,340 | 3/1966 | Knohl | 66/178 A X |
| 3,263,454 | 8/1966 | Butler | 66/136 X |
| 3,626,714 | 12/1971 | Blore | 66/196 |

FOREIGN PATENT DOCUMENTS

| | | | |
|---|---|---|---|
| 1,418,465 | 12/1964 | France | 66/202 |
| 1,295,075 | 4/1962 | France | 66/202 |
| 1,917,373 | 10/1970 | Germany | 66/200 |
| 782,438 | 9/1957 | United Kingdom | 66/202 |
| 433,213 | 8/1935 | United Kingdom | 66/197 |
| 758,663 | 10/1956 | United Kingdom | 66/197 |

OTHER PUBLICATIONS

Prelog, L. *New Fabrics From Old Machines* In Knitting Times, 40(38) pp. 67–73, Sept. 13, 1971.

Beebe, P. R. *Shaping Up the 70's Knitwear Styles With Lycra Elastomeric Yarn,* in the Hosiery Trade Journ. 80(1960) pp. 100–103, Dec. 1973.

Hicks, E. M. *Lycra Spandex Fiber I Structure and Properties* in the American Dyestuff Reporter pp. 33–35 Jan. 7, 1963.

Bulletin L-71, Sept. 1970, DuPont Technical Information.

Knitting Times, Feb. 15, 1971, vol. 41, No. 7 pp. 39–48.

*Primary Examiner*—Mervin Stein
*Assistant Examiner*—Andrew M. Falik
*Attorney, Agent, or Firm*—Allison C. Collard

[57] ABSTRACT

An elastic fabric containing producers twist continuous filament yarns, which in spite of their features make it possible to obtain a fabric having high elasticity and power stretch indexes; said synthetic yarns are knit just as issued from spinning, without previously being submitted to any texturing or warping operation, in a large diameter interlock type circular machine, with two sets of needles, on a pique basis and with interlacing interlock and jersey courses. In the interlock courses a first synthetic yarn is incorporated, while in the jersey courses a polyurethane originated elastomeric yarn tensioned under control, having as a companion or carrier yarn a second synthetic yarn, is incorporated.

2 Claims, 3 Drawing Figures

HIGH LUSTER INTERLOCK FABRIC INCORPORATING PRODUCER TWIST YARNS

BACKGROUND OF THE INVENTION

The present application is a continuation-in-part of applicants' prior application Ser. No. 370,874 filed on June 18, 1973 now abandoned.

The present invention relates to a novel fabric, particularly a fabric having high elasticity and power stretch.

This new fabric is the positive result of thorough tests and trials carried out with the main purpose of achieving at a commercial scale a fabric which, due to its construction, good appearance and moderate cost, will stand out advantageously in comparison with certain conventional type elastic fabrics available at present in the market.

It is a known fact that the quality of a fabric represents the sum total of a series of factors, conditions and elements which properly interrelated allow the proposed performance to be achieved. Thus, this novel fabric we have created offers as an outstanding feature that which the textile industry calls "hand", that is, that the fabric possesses a very soft feel, which under the requirements of today's fashion is an interesting and much sought contribution.

As stated before, there are various elastic fabrics in the market, their elasticity normally depending on two factors; the one, given by the stitch produced by the knitting machine; the other by the yarn itself, that is, that if we take as an example the case of a fabric of the so-called "stretch" type, one may assign a value of 1 to the degree of elasticity obtained with the knitting machine, and a value of 2 to the proper degree of elasticity provided by the yarn, the latter being a yarn texturized in a "stretch" system providing it with a high elasticity.

The sum of the yarn value 2 plus the machine value 1 totals a value of 3 which can be obtained purely and exclusively with texturized type yarns.

Obviously, if rigid or inelastic type yarns such as cotton, wool, acetate or any equivalent one based on natural or synthetic fibers are to be used, the degree of elasticity of the yarn descends to a very low value which, taking into account the relative values we are using an an example, would finally reach an extremely low value; this means that in the case of said rigid yarns the degree of elasticity of the fabric will be given exclusively by the stitch of the knitted fabric. Consequently, a fabric knitted with a cotton yarn may be assigned the same value 1 assigned to the previous one, but as on its part the low elasticity of the fabric results in a practically zero value, the degree of elasticity of the fabric would only be of a value 1.

SUMMARY OF THE INVENTION

It is therefore an object of this invention to provide a novel type of elastic fabric having high elasticity and power stretch indexes, using unconventional yarns having a lower cost than yarns currently used for elastic fabrics at present in the market.

It is a more specific object of this invention to provide a novel type of elastic fabric having high elasticity and power stretch indexes, knitted in a circular machine of interlock basis, and comprising rigid synthetic yarns not previously texturized or warped, which define rigid yarns knitted in pique interlacing on the basis of an interchange of courses of interlock and jersey, the rigid yarn forming the jersey stitch courses constituting a carrier or "companion" for a polyurethane originated elastomeric fiber tensioned under control, forming together with the rigid yarn said jersey stitch courses.

One of the basic features of the novel fabric we have developed is precisely the inclusion therein as the main component, in a proportion ranging from 87 to 89 percent, of a yarn known in the art as a producer or prim twist, i.e., a yarn directly issued from spinning and not subsequently submitted to any texturizing process, thus being a rigid yarn.

If this yarn were knitted in a circular machine, it would have a practically zero degree of elasticity, as the elasticity of the resulting fabric would be provided only by the machine.

The novel fabric of the present invention, precisely due to its construction and components -one of the, fundamental by being an elastomeric yarn of spandex origin- makes it possible to obtain therewith a degree of elasticity and power stretch that normally would have to be provided by a type of fabric made with a texturized yarn. This means that by starting from a yarn which would enable one to obtain conventionally a fabric having an elasticity of 1, it is possible to obtain a fabric attaining an elasticity value of 2½ and a higher power stretch.

According to this invention, the possibility of obtaining precisely an excellent elasticity with a type of yarn which shall hereinafter be referred to as a producer twist or rigid yarn is essential. Since a producer twist or rigid yarn instead of a so-called texturized yarn is used, several fundamental conditions can be obtained. In the first place, an extremely soft hand, as a normal feature for a non-texturized yarn; secondly, the actual possibility of a fabric having a clean, smooth appearance, i.e. a smooth surface which is the basic contribution of a producer yarn, in contrast with any fabric made with texturized yarn, which presents a spongy surface somewhat similar to crepe, while the new developed fabric offers, apart from a very smooth hand and an excellent "wet-hand", a full, fleshy and absolutely non gummy or spongy hand.

Another negative detail in the texturized yarn as compared with the yarn used in this invention lies in that having been submitted to a "swelling" process it exhibits an air retention within the fiber mass, which causes a voluminous thickness; while in the fabric of the invention, since such a possibility of "swelling" does not exist, one can obtain a much "flatter" fabric.

Also worth mentioning is the fact that in using a producer twist or rigid yarn in the new fabric, a remarkable luster is achieved, so that the fabric has both an excellent luster and a good satin look. These features are neither normal or achieved in a fabric made with texturized yarn, even in the case of high quality and high cost fabrics.

One should also point out in respect of the fabric of the invention that non-texturized yarn, i.e. the producer twist or rigid yarn, has a far lower cost than texturized yarn. Indeed, a texturized yarn is initially a producer twist or rigid yarn subsequently submitted to a series of processing operations and passing several commercial stages, all of which, of course, cause a considerable increase in the cost of said texturized yarn.

Regarding the brightness of the fabric, mentioned above, it is worthwhile to note that apart from the producer twist or rigid yarn, which is a semi-dull yarn having luster on account of its not being texturized, we have contemplated increasing or emphasizing said brightness in the fabric by incorporating thereinto a further producer twist or rigid yarn, but in this case of a trilobal fiber, this yarn precisely being the one added or associated with the aforementioned elastomeric yarn of spandex origin. The main feature of said trilobal fiber is that while all producer twists or rigid yarns, either semi-dull or bright, present a circular cross-section, said fiber shows a cross-section forming three lobes or rounded projections (a configuration resembling a clover leaf), giving rise to formation of different light reflecting faces causing a very bright yarn.

In addition to the logical balance that should exist between yarn number and machine features, the amount of filaments forming the yarn is extremely important, for the simple reason that the higher the number of filaments so much the more will the smoothness of the fabric be, while with a lower amount of filaments the fabric will be coarser. These significant details show that if instead of using, for instance, a 90/28 yarn a 90/10 or 90/14 yarn is employed, the features themselves of the fabric would be far more rough than if the first named yarn were used; on the other hand, if a 90/36 yarn is used instead of a 90/28 yarn, an increase in the fabric's softness will automatically be obtained, so that it shall readily be understood that there is the possibiity of a substantial number of variations as far as yarn numbers are concerned.

If the process whereby the novel fabric of the invention is produced in a circular interlock type machine of, for instance, 28 needles per inch, the variations in deniers to manufacture the novel fabric may fluctuate between 80 and 90 deniers, approximately, because if they were perceptibly to exceed such limits a good coverage would not be obtained, i.e., openings in the fabric might be noted. In short, there must be a necessary and preestablished equilibrium between yarn deniers and machine fineness, which is the same as saying yarn number and machine gauge, since gauge means in the art number of needles per inch.

The novel fabric and the process for producing it have been developed taking into account that conventional fabrics including elastomeric fiber exist, which are made in a warp knitting machine. But in this case there is a very important negative factor, which complicates and substantially increases the cost of said production in a warp knitting machine: the elastomeric fiber must be used already warped, that is, wound on warp beams wherein the required number of elastomeric fiber yarns are provided already warped.

This means that, considering the source of said raw material (polyurethane elastomeric fiber) whoever may want to undertake the above manufacture will forcibly have to buy the warped beams of elastomeric fiber, with all the resulting evident difficulties of a practical and economic order, because a raw material having in itself a high cost suffers a severe increase therein by having to undergo said prior warping operation.

On the other hand, in the novel fabric of the invention and in the process for producing it, the elastomeric yarn is used simply from the cone, that is to say, just as it comes wound on the cone when placed in the creel for warping, so that, as with the producer twist or rigid yarn, it can be purchased directly from the spinning mill. Normally the same supplier of elastomeric yarn not only sells it in tubes, but also beamed, a case similar to texturized yarns; however, by this additional process the yarn substantially increases its cost, much more notable due to the already high cost of elastomeric fiber itself.

It is also worth mentioning that in elastic fabrics processed in warp knitting machines it is quite difficult to limit the elastomeric fiber percentages, which generally are as high as 25%, that is to say, that in each kilogram of fabric there are 250 grams of elastomeric fiber included. Taking into account the extra charge the prior operation implies, it is easy to see the reason for the extremely high cost of such conventional fabrics.

Instead, in the novel fabric and the method for making it, the percentage of elastomeric fiber incorporated therein is in the range of 5 to 7 percent, so that there is practically a 20 percent saving of elastomeric fiber for fabrics having very similar features. It should be born in mind that we are not speaking of equal fabrics, but of equal features of same, for example as to elasticity, recovery power, a certain similitude in hand or feel, but in no way as to thickness, because a fabric made in a warp knitting machine is always far thinner and of a much lesser weight per area unit than the fabric of the invention. The latter, in a line oriented, for instance, towards the manufacture of swim suits and other garments, offers optimum conditions of thickness, elasticity, compactness, etc., in comparison with other conventional fabrics in which, as in the case of those made in warp knitting machines, an interesting degree of elasticity is obtained, but in spite of their high percentages of elastomeric fiber have a relatively lower recovery power.

In order to provide a clear and ready understanding of the present invention three illustrative drawings are accompanied diagramming the fabric and the manufacturing process according to a preferred embodiment, with a purely exemplary and in no way limitative purpose.

DETAILED DESCRIPTION OF THE PREFERRED EMBODIMENT

As shown in the accompanying drawings, the novel fabric of the invention comprises in its essential arrangement rigid synthetic yarns with no previous texturing or warping, which as producer twists or rigid yarns are pique knitted on the basis of interchanging courses of interlock and jersey; and annexed to the rigid yarn forming the courses of jersey stitches there is an elastomeric fiber of polyurethane origin under controlled tension.

Figure 1:
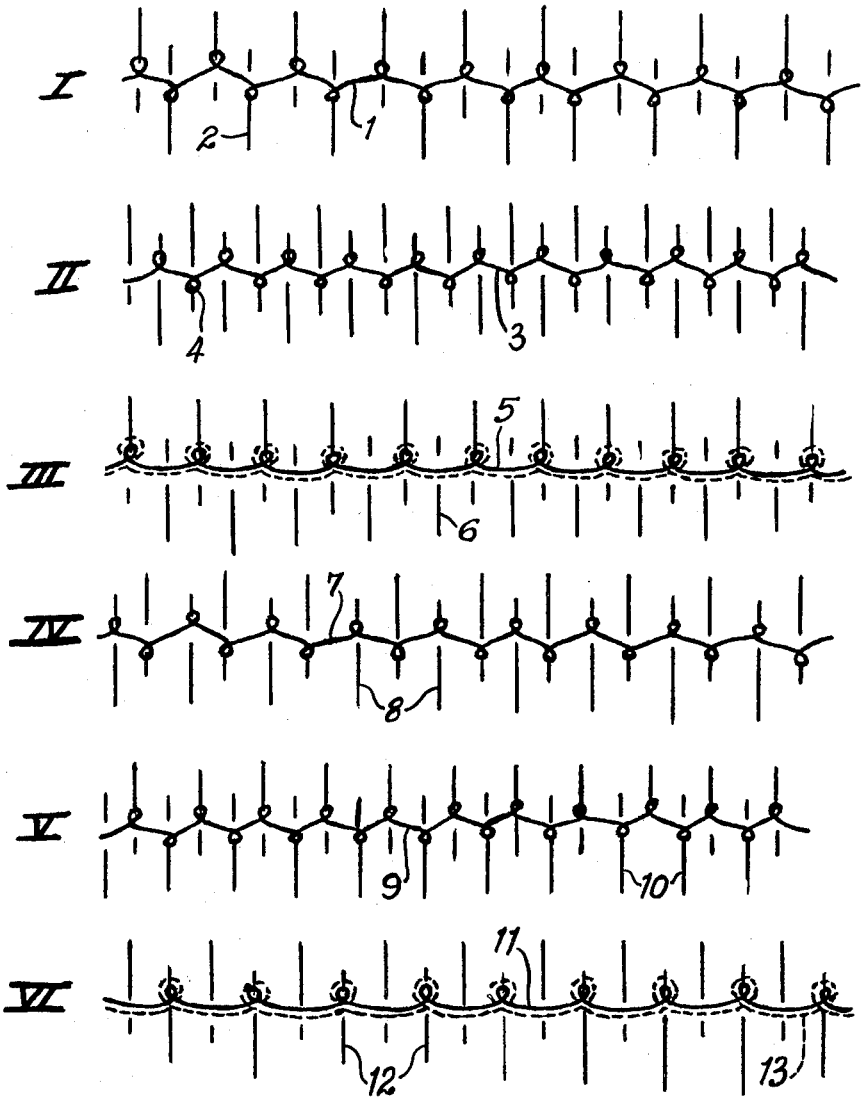
FIG. 1 is a diagram showing unfolded according to the current textile standards a knitting cycle of the novel fabric of the invention.

The above basic arrangement corresponds to a fabric produced in an interlock type large diameter circular knitting machine according to knitting or construction cycles as the one shown in FIG. 1 of the drawings, wherein numerals I to VI indicate the several courses forming said construction and to which the respective feeders correspond.

According to that order and following a procedure used to produce the fabric of the invention, course I evolves with a rigid yarn 1, consisting, for example, in a polyamide yarn having a 90 denier number, the feeder of which works in interlock with long needles identified by reference numeral 2; course II is made with rigid yarn 3, based on polyamide fiber of a 90 denier number, the feeder working in interlock with short needles shown at 4; course III is conducted with rigid yarn 5 of a 40 denier number polyamide fiber, its feeder knitting jersey with long needles indicated at 6; course IV consists of rigid yarn 7 of a 90 denier number polyamide fiber, the feeder working in interlock with short needles 8; course V is formed with rigid yarn 9 of a 90 denier number polyamide fiber, the feeder working in interlock with long needles shown at 10, while course VI is made with rigid yarn 11 of a 40 denier number polyamide fiber, its feeder working jersey with short needles 12.

According to the process and on the pique basis outlined above, the polyurethane originated elastomeric fiber is incorporated. To such effect, in jersey courses III and VI preferably consisting of a trilobal rigid yarn having a 40 denier number, the above mentioned elastomeric fiber is directly introduced in the needle so as to be accompanied by said rigid yarn identified at 5 and 11, the elastomeric fiber being indicated in both courses by reference numeral 13, it may have, for instance, a 70 denier number. It is interesting to note that both the yarns as the yarn numbers mentioned above are simply demonstrative and not limitative examples.

One of the advantages of this process of rigid yarn knitted with elastomeric or spandex yarn in a circular machine for producing the fabric of the invention lies in the fact that this fabric can be perfectly dyed with a wide line of dyestuffs allowing at the same time any variation in shades.

Normally a fabric including elastomeric or spandex yarn has problems during the dyeing process due to various circumstances, one of them residing in that elastomeric yarn has to be well under control so as to avoid the play of tensions, which normally may cause differences in the width, or differences in tension, with the consequence being that part of the fabric wrinkles while the other does not. Furthermore, in the case of elastic fabrics processed in a warp knitting machine the problem arises that the elastomeric yarn, or at least part of it, is exposed and this forces the dyer to undertake a careful selection of dyestuffs in order to obtain a good leveling of shades, because if there are defects in said levelling two-color effects are caused which devaluate the fabric and are even a motive for rejection by the customer.

In the process for producing the fabric of the invention, the elastomeric yarn is completely "hidden" or is invisible in the face of the fabric, so that it is possible to treat it as a common polyamide fabric; however, it is always sought to give the elastomeric yarn a good covering; this, however, should not be taken as limitative. Moreover, save in the case of black, any color can be achieved without need of working with selected dyestuffs because even if the elastomeric yarn does not take dye and remains white, it is in no way directly visible in the face of the fabric, so that in fact there is no problem.

The three basic components used in manufacturing the fabric of the invention are constituted by 90/28 rigid yarn which may be a polyamide yarn, or even a polyester yarn, incorporated into the fabric in a 87 to 88 percent proportion; a second, 40/10 yarn, also polyamide and having a trilobal cross section, included in a proportion of 5 to 7 percent on the total weight of the fabric, and finally a polyurethane originated elastomeric yarn is an amount representing from 5 to 7 percent of the total weight of the fabric.

The types and proportions of the above yarns are considered a mere example devised to achieve a perfect balance with the knitting machine, a circular knitting machine (with two sets of needles), 28 needles per inch. It will be easy to see that on the basis mentioned above there is a wide range of variations demanding as the only requirement a proper balance between the yarns and the machine gauge, that is, the number of needles per inch.

As already mentioned, the present process is carried out with the help of a large diameter circular knitting machine, interlock type, provided with Rossen type furnishers, which ensure perfect feeding regularity plus an absolute uniformity in the resulting fabric, with no possibility or barre problems. The machine is equipped with, for example, 36 feeders to produce six cycles, one of which has already been discussed in detail hereinbefore. One of the basic points in the process for producing the fabric of the invention is not only the possibility of introducing an elastomeric yarn in the machine, but also of retaining or maintaining such a yarn in the machine according to a required position.

Figure 3:
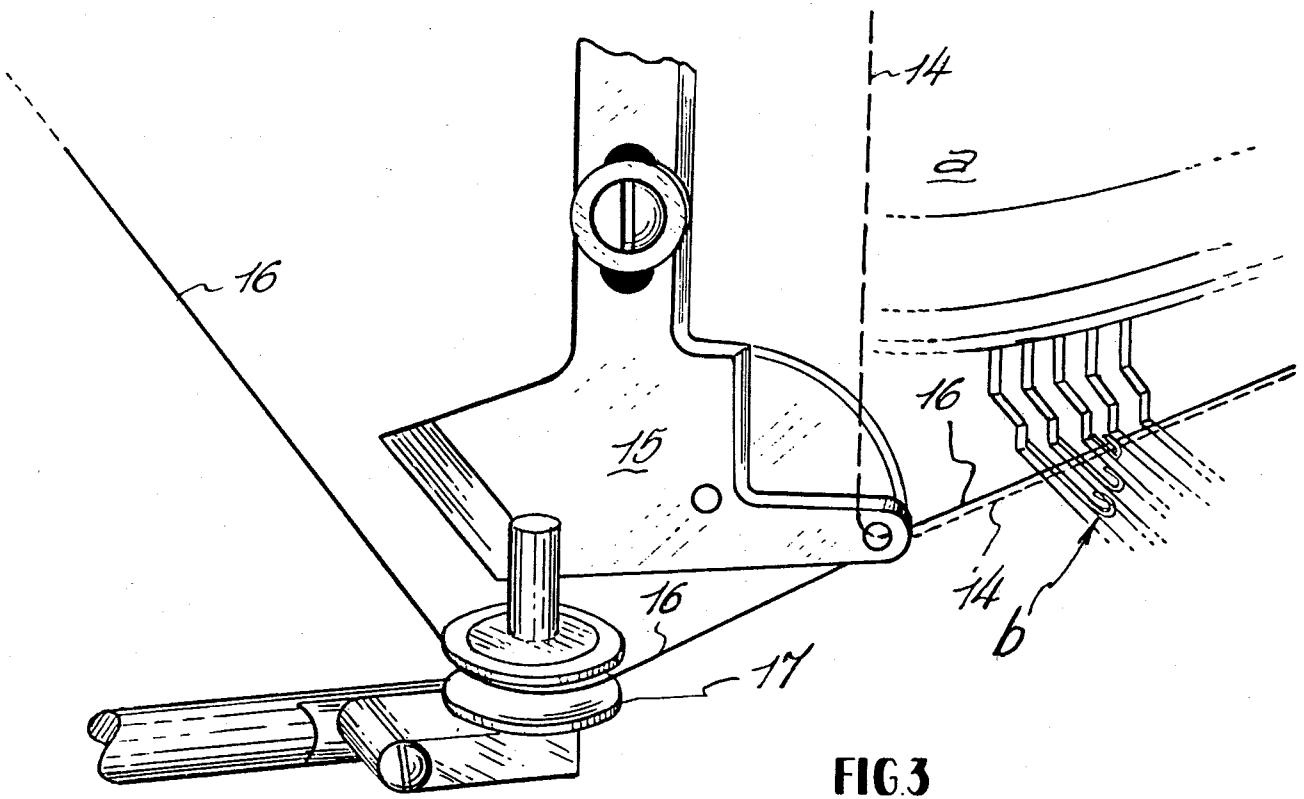
FIG. 3 is a schematic illustration showing how the elastomeric yarn and the corresponding rigid yarn acting as carrier thereof are directly fed to the needles, In the several Figures, the same reference characters indicate equal or corresponding parts.

This has been achieved by attaching to the trilobal hard yarn part of the fabric the role of carrier or "companion", with the addition of an action which even if appearing rather unorthodox is one of the main aspects of the process for making the fabric of the invention, to wit, to feed two threads to one and the same needle, and this is shown in FIG. 3 of the drawings. In this figure, *a* indicates the corresponding section of the machine and *b* the needles thereof, the rigid yarn being shown in dash lines 14 and running through yarn-guide 15, while reference numeral 16 indicates the elastomeric yarn trained around a small pulley 17. Both yarns 14 and 16 are directed, as indicated by the drawing, so as to be positioned in such a manner that upon arrival at needles *b* they may be jointly caught by the needles as the jersey courses III and VI of FIG. 1 are developed.

Figure 2:
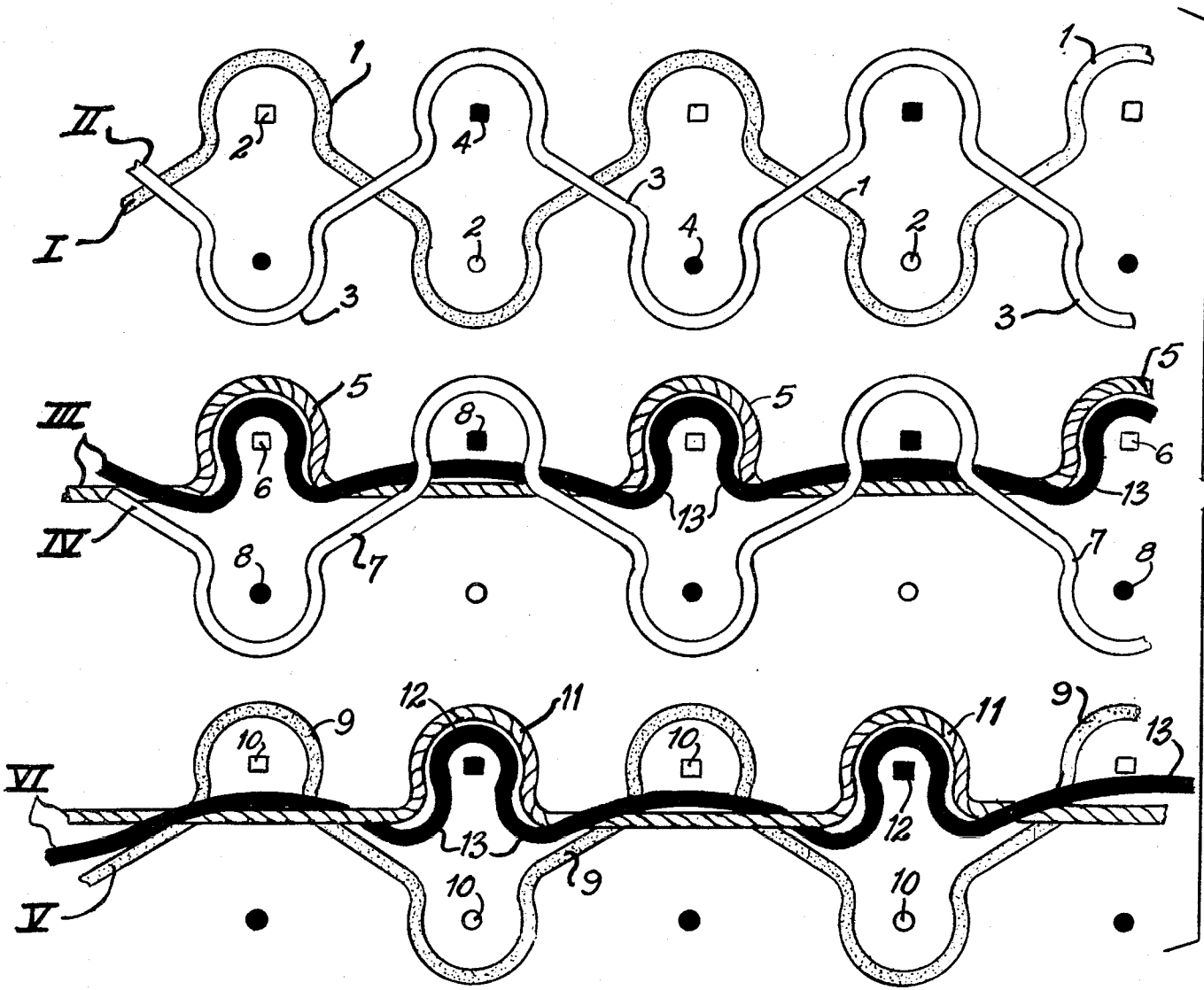
FIG. 2 is a schematic illustration showing the arrangement of courses forming the fabric and their location relative to the respective needles.

Complementary to the diagram of FIG. 1 -which is the normal way of illustration in the textile art- and with the purposes of providing a more clear interpretation of the invention, the knitting courses are shown schematically in FIG. 2 as separated, instead of overlapped as in practice, so that to follow them or distinguish them in the fabric is quite difficult if not impossible. Thus, in the flat arrangement shown, the course numbers I to VI and the reference numbers 1 to 13 are the same as those used in FIG. 1, and further the courses are shown by distinctive means (white, dot-shaded, line-shaded and blacked), location of the needles being indicated by small blacked circles for the short cylinder needles, small white circles for the long cylinder needles; while white squares indicate long dial needles and and black squares identify the short dial needles.

The schematic drawing of FIG. 2 clearly shows how the rigid yarn 5 or 11 and the polyurethane fiber yarn 13 are taken up together by needles 6 or 12.

We claim:

1. An elastic knit fabric characterized by a lustrous smooth surface and a soft hand comrising continuous filament producer twist synthetic yarn, not previously texturized or warped, knitted on a double bed circular knitting machine of interlock basis with a set up of alternately arranged long and short needles in each bed, according to a cycle of six interchanging interlock and jersey courses wherein the long needles only knit in the odd courses while only the short needles knit in the even courses, said synthetic yarns in the jersey courses plaited with a polyurethane originated elastomeric yarn fed under tension, forming together with said continuous filament synthetic yarn said jersey stitch courses.

2. The knit fabric according to claim 1, wherein said continuous filament yarns are formed of polyamide filaments.

* * * * *